US006283479B1

(12) United States Patent
Jan

(10) Patent No.: US 6,283,479 B1
(45) Date of Patent: Sep. 4, 2001

(54) HIGH TEMPERATURE LOW LEAKAGE SEAL FOR A SHAFT ON A GAS TURBINE ENGINE

(75) Inventor: Shihming Jan, Solana Beach, CA (US)

(73) Assignee: Solar Turbines Incorporated, San Diego, CA (US)

( * ) Notice: Subject to any disclaimer, the term of this patent is extended or adjusted under 35 U.S.C. 154(b) by 0 days.

(21) Appl. No.: 09/288,422

(22) Filed: Apr. 8, 1999

(51) Int. Cl.[7] ..... F02F 11/00
(52) U.S. Cl. ..... 277/591; 277/592; 277/650
(58) Field of Search ..... 277/591, 592, 277/650, 652

(56) References Cited

U.S. PATENT DOCUMENTS 3,907,311 * 9/1975 Rao .
4,486,002 * 12/1984 Riess et al. .
4,704,332 * 11/1987 Brennan et al. .
5,014,999 * 5/1991 Makhobey .
5,217,232 * 6/1993 Makhobey .
5,221,096 * 6/1993 Heldreth et al. .
5,292,138 * 3/1994 Glynn et al. .
5,305,609 * 4/1994 Guinan et al. .
5,346,136 * 9/1994 Bassett .
6,003,792 * 12/1999 Munezane et al. .

* cited by examiner

*Primary Examiner*—Anthony Knight
*Assistant Examiner*—James M. Hewitt
(74) *Attorney, Agent, or Firm*—Keith P. Roberson

(57) ABSTRACT

A sealing arrangement improves sealing of a shaft in a control system on a gas turbine engine. The sealing arrangement includes a first plate and a non-metallic plate. The non-metallic plate has a glass transition temperature above an operating temperature range. The non-metallic plate and the first plate are disposed between a high temperature, high pressure fluid and a low pressure fluid.

4 Claims, 4 Drawing Sheets

HIGH TEMPERATURE LOW LEAKAGE SEAL FOR A SHAFT ON A GAS TURBINE ENGINE

TECHNICAL FIELD

This invention relates generally to a gas turbine engine and more particularly to a low leakage non-metallic seal interposed a high pressure fluid and a low pressure fluid being positioned about a rotating shaft.

BACKGROUND ART

Gas turbine engine performance is very dependent on maintaining a tight seal between a high pressure region and a low pressure region. These regions are present throughout the gas turbine engine including regions between the turbine stages, compressor stages, and other locations.

To add to the complexity of sealing the high pressure region from the low pressure region, many of the seals in the gas turbine engine are established between moving parts. In one particular application, a shaft seal prevents a hot, high pressure gas from moving between a housing and a rotating shaft into a low pressure gas. Current sealing arrangements such as C-seals, E-seals, bellows seals, and Garlock seals tend to wear quickly. The wear of these seals is further exacerbated by leakage through these seals.

Some manufacturers use a plurality of non-metallic seals in a piston ring fashion. These seals may work well in a low temperature environment. However, the non-metallic seals tend to have reduced mechanical strength at higher temperatures. The reduced mechanical strength allows the seals to lose their shape or fail to return to their original shape. Leaking increases as the seals loose their mechanical strength. At higher temperatures, the leakage rates will oxidize the seal and further increase leakage. In some instances leakage may create problems controlling the gas turbine engine.

The present invention is directed to overcome one or more of the problems as set forth above.

DISCLOSURE OF THE INVENTION

In one aspect of the invention, a seal is formed between a shaft and a housing. The seal has a first plate disposed about a circumference of the shaft and an inner periphery of the housing. The first plate has a first side and a second side. The first side of the first plate is exposed to a low pressure fluid. The first plate has high temperature mechanical strength and is adapted to provide structural support. A non-metallic plate is disposed about the circumference of the shaft and the inner periphery of the housing. The non-metallic plate has a first side and a second side. The first side of the non-metallic plate is adjacent to the second side of the first plate. The second side of the non-metallic plate is adjacent to a high pressure fluid. The non-metallic plate has a glass transition temperature above a predetermined temperature.

In another aspect of the invention, a method is defined for sealing a high pressure fluid on a first side of a shaft from a low pressure fluid on a second side. The high pressure fluid is separated from the low pressure fluid with a non-metallic material having a glass transition temperature above an operating temperature of the high pressure fluid. The non-metallic material is supported structurally to maintain a predetermined shape.

In a further aspect of the invention, a control system for a gas turbine engine has a sealing arrangement. The sealing arrangement has a housing with a first portion and a second portion. The second portion is spaced from the first portion. The first portion is proximate a low pressure fluid. The second portion is proximate a high pressure fluid. A shaft is disposed in the housing. The first seal is disposed proximate the first portion. The first seal is intermediate the shaft and the housing. The first seal has high temperature mechanical strength. A non-metallic seal is disposed intermediate the first seal and the second portion. The non-metallic seal is intermediate the shaft and the housing. The non-metallic seal has a glass transition temperature above an operating temperature of the high pressure fluid.

BEST MODE FOR CARRYING OUT THE INVENTION

Figure 1:
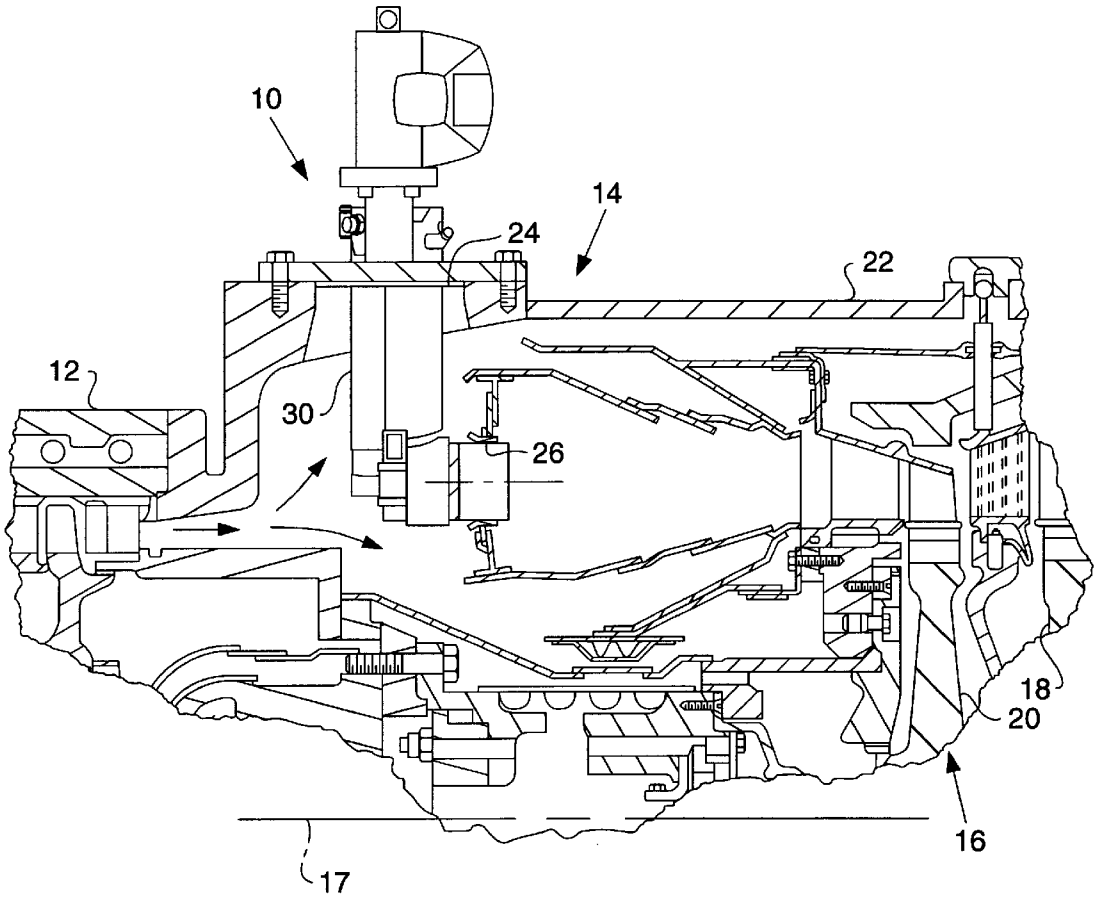
FIG. 1 is a partially sectioned view of a gas turbine engine embodying the present invention.

As seen in FIG. 1, a gas turbine engine 10 has a compressor section 12, a combustor section 14, and a turbine section 16 disposed about a central axis 17. The combustor section 14 in this application is positioned between the compressor section 12 and the turbine section 16. Both the compressor section 12 and the turbine section 16 fluidly connect with the combustor section 14. The turbine section 16 and compressor section 12 mechanically connect generally by a shaft (not shown). However, any conventional gearing arrangement may be used.

The turbine section 16 includes a power turbine 18 and a gas producing turbine 20. The gas producing turbine 20 mechanically connects to the shaft (not shown). The power turbine 18 is connected to a second shaft (not shown) suitable for driving some external accessory (not shown).

The combustor section 14 is defined by an outer housing 22. The outer housing 22 generally extends between the compressor section 12 and the turbine section 16. The outer housing 22 has a plurality of regularly spaced openings 24 having a pre-established position in relation to one another. In this application, the openings 24 are positioned around the outer housing 22 near the compressor section 12. While this application shows an annular type combustor, a plurality of can-type combustors or a can-annular type combustor may also be used without changing the essence of the invention. Each of the regularly spaced openings 24 has a corresponding second regularly spaced opening 26. A fuel injector 30 passes through each regularly spaced opening 24 into the corresponding second regularly spaced opening 26.

Figure 2:
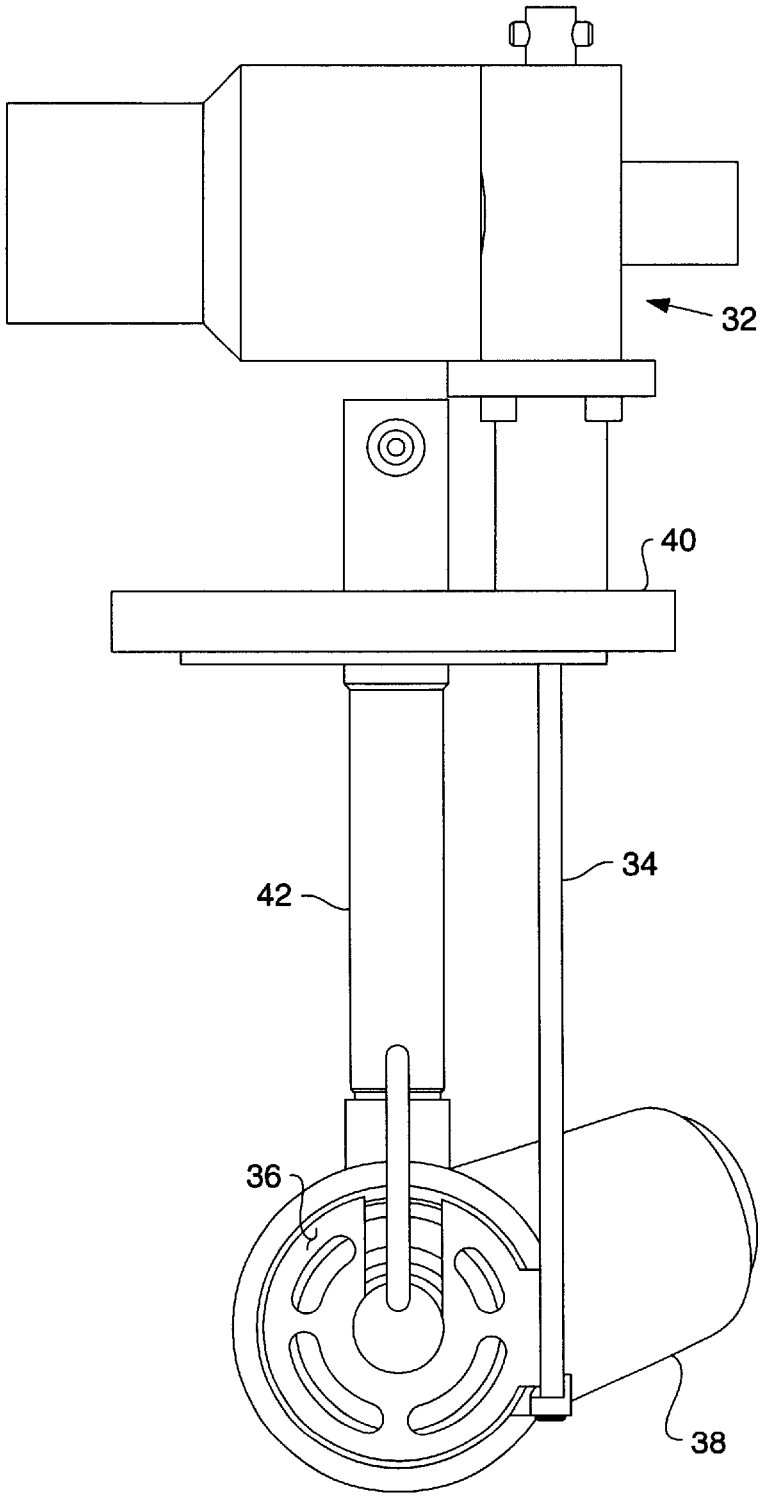
FIG. 2 is a drawing of a fuel injection valve for a gas turbine engine embodying the present invention.

As shown in FIG. 2, the fuel injector 30 is shown having a sealing arrangement 32, a shaft 34, a flow restriction device 36, a fuel injector body 38, a fuel injector connection portion 40, and a fuel transfer portion 42. The fuel transfer portion 42 connects the fuel injector connection portion 40 to the fuel injector body 38. The fuel injector connection portion 40 connects to the outer housing 22 such that the fuel transfer portion 42 and fuel injector body 38 are inside of the outer housing 22. The flow restriction device 36 pivotally connects with the fuel injector body 38. The shaft 34 connects between the flow restriction device 36 and the sealing arrangement 32. In this application, the sealing arrangement 32 connects with the fuel injector connection portion 40.

Figure 3:
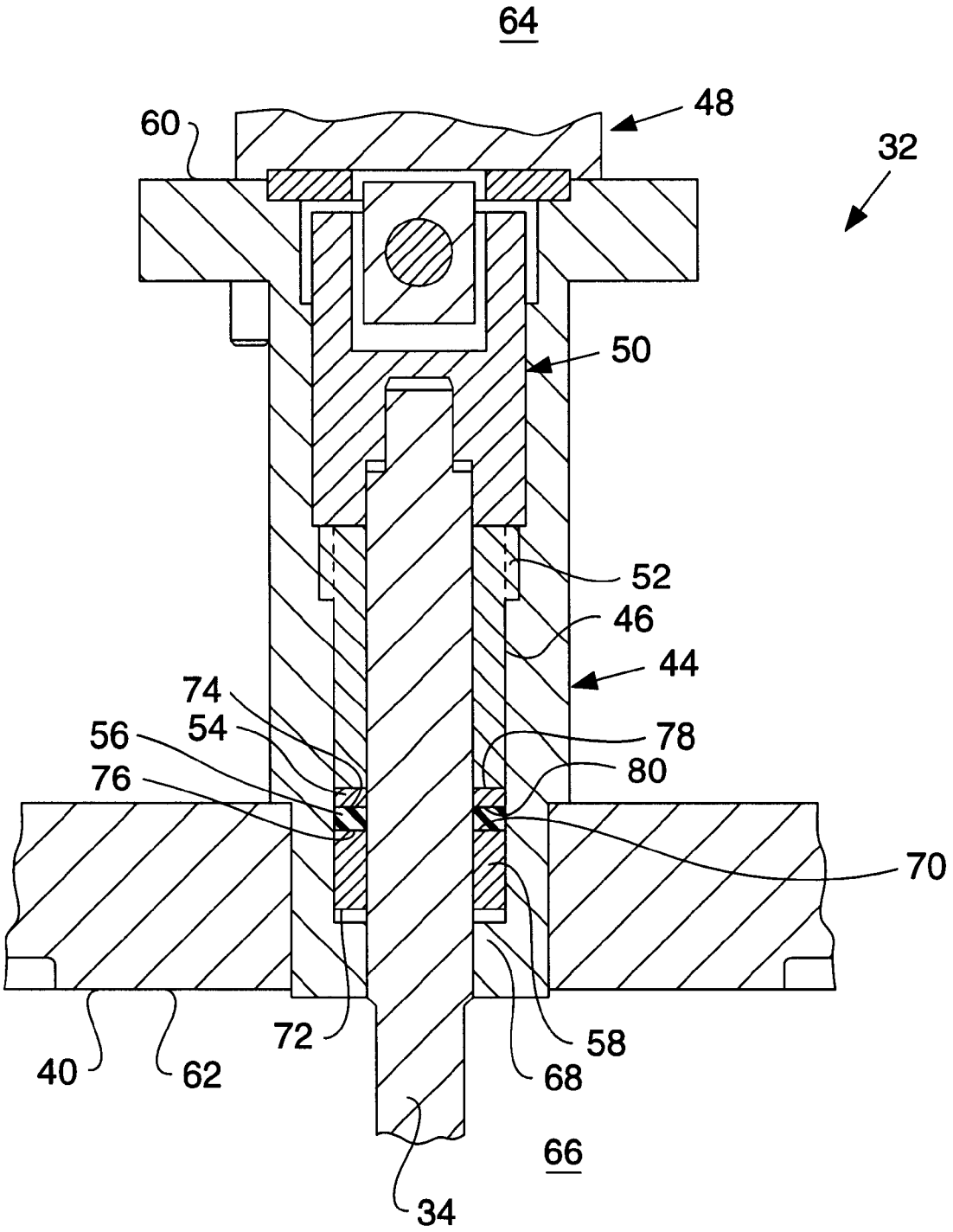
FIG. 3 is a partial cross-sectional view of the fuel injection valve in FIG. 2.

FIG. 3 shows the sealing arrangement 32 having a housing 44, a bore 46, valve actuator 48, a connector 50, a nut 52, a first plate 54, a non-metallic plate 56, and a graphite plate 58. While the sealing arrangement 32 is shown for a fuel injector 30, the sealing arrangement 32 will work with other shaft and housing interactions found in gas turbine engines or other systems where trying to separate hot, high pressure fluid from lower pressure fluid. The housing 44 in this application has a first portion 60 and a second portion 62. The first portion 60 is exposed to a low pressure fluid 64. For the particular example, the low pressure fluid 64 may be at atmospheric pressures and temperatures from about −40° F. to 130° F. (−40 C to 54.4 C). In this application the second portion 62 is exposed to a high pressure air 66 ranging in pressure from about 14.7 psia to 235 psia (1.014 kPa to 1620 kPa) and about −40° F. to 640° F. (−40 C to 338 C). The housing 44 has a lip portion 68 proximate the second portion 62. The lip portion 68 represents one of numerous conventional methods that could be used to secure the graphite plate 58 within the housing 44. The shaft 34 is generally a circular cylinder having a circumference.

In the embodiment shown in FIG. 3, graphite is used as a sacrificial material to prevent oxidation of the non-metallic plate 56 however, other oxidation promoting material may be used such as plain carbon steel. The graphite plate 58 has a first side 70 and a second side 72. The second side 72 of the graphite plate 58 rests against the lip portion 68 of the housing 44. In this application all of the plates 54, 56, and 58 are disk-shaped having a bore portion adapted to receive the shaft 34, but other shapes may be used. Each plate 54, 56, and 58 is continuous except for the bore portion. The graphite plate 58 initially tightly engages the housing 44 at the periphery of the housing bore. After several rotations of the shaft 58, the graphite plate 58 loses contact with the shaft 34. The non-metallic plate 56 has a first side 74 and a second side 76. The second side 76 of the non-metallic plate 56 is positioned adjacent the first side 70 of the graphite plate 58. The non-metallic plate 56 tightly engages the housing 44 at the periphery of the housing bore 46. The bore portion of the non-metallic plate 56 tightly engages the circumference of the shaft 34.

The non-metallic plate 56 is made of a material having a glass transition temperature above an operating range of about 650° F. (338 C) experienced by the fuel injector 30. A polyimide going by the trademark VESPEL ST is an example of a material having an infinite glass transition temperature meaning that VESPEL ST will not melt at any temperature. VESPEL ST can be easily machined into numerous shapes. Preferably, the non-metallic plate 56 will also have a coefficient of thermal expansion greater than a coefficient of thermal expansion of the housing 44.

The first plate 54 has a first side 78 and a second side 80. The second side 80 of the first plate 54 is adjacent the first side 74 of the non-metallic plate 56. The first plate 54 has an inside diameter slightly greater than the shaft 34 and slightly smaller than the bore 46. The first plate 54 in this application may be made of any material exhibiting high mechanical strength in the operating temperature range. Mechanical strength being the ability of a material to retain its shape under mechanical loading including tensile, compressive, and shearing stress. Preferably the first plate 54 is made of a high temperature alloy like stainless steels or nickel alloys such as Inconel, Monel, and Hastelloy. These materials typically retain their tensile strength over wide temperature ranges. Additionally these materials resist oxidation at high temperatures.

The nut 52 is shown in FIG. 1 threadably engaging the housing 44 and adjacent to the first side 78 of the first plate 54. This represents only one method of compressing the plates 28, 30, 32 into contact with one another. Other conventional methods may also be used such as snap rings. The actuator 64 connects to the shaft 34 through the connector 50.

Figure 4:
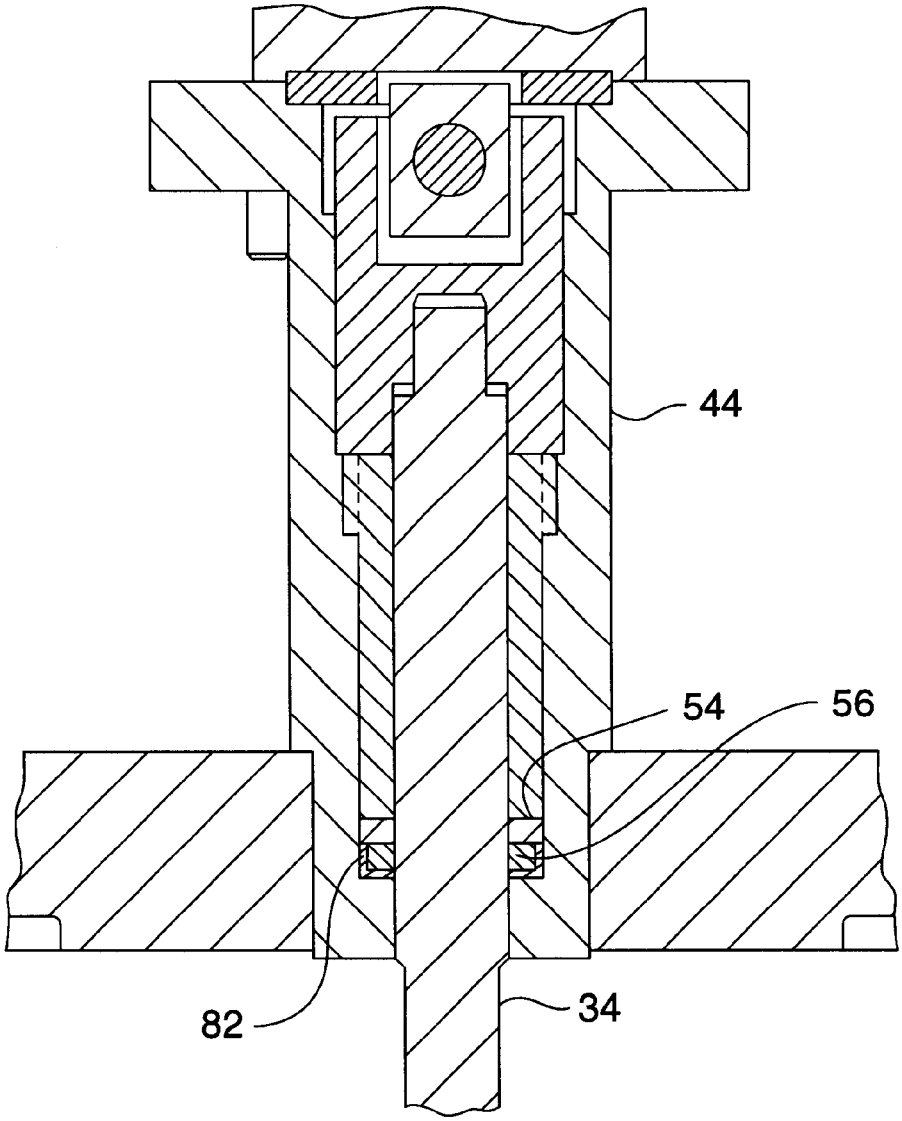
FIG. 4 is a partial cross-sectional view of the fuel injection valve in FIG. 2 having an alternative embodiment of the present invention.

An alternative embodiment in FIG. 4 replaces the graphite plate 58 with either an oxidation prone material 82 or oxidation resistant material placed intermediate the non-metallic plate 56 and the high pressure fluid 66. In this application, the oxidation prone material 82 is shown as a coating on the non-metallic plate 56.

Other aspects, objects and advantages of this invention can be obtained from a study of the drawings, the disclosure and the appended claims.

Industrial Applicability

The sealing arrangement 32 reduces leakage of the high pressure fluid 66 to the low pressure fluid 64 along the shaft 34. In the present embodiment, the sealing arrangement 32 greatly reduces leakage by using the non-metallic plate 56 to prevent leakage between the shaft 34 and the housing 44. The non-metallic plate 56 differs from normal elastomers or plastics. Typical elastomers and plastics have good resilience at low temperatures. However, these materials begin to flow and loose their shape or disintegrate as the temperature increases past their glass transition temperature. In this application, the non-metallic plate 56 will retain its general shape during normal operating temperatures of the gas turbine engine. The non-metallic plate 56 will, however, start losing its mechanical strength when its temperature is above about 100° F. (37.8 C).

The first plate 54 in association with the graphite plate constrains the non-metallic plate 56 from expanding axially along the shaft 34. As the temperature increases, the sealing arrangement 32 further improves sealing. The lower thermal expansion of the housing 44 will prevent the non-metallic plate 56 from expanding radially outward. The non-metallic plate 56 will generally expand radially inward and increase interaction between the non-metallic plate 56 and the shaft 34.

The graphite plate 58 further protects the non-metallic plate 56 by oxidizing prior to the non-metallic plate 56. Preliminary oxidation of the graphite plate 58 prevents oxygen from reaching the non-metallic plate 56.

Instead of using the graphite plate 58, the other embodiments may use either an oxidation prone material 82 on the second side of the non-metallic plate. The oxidation prone material 82 will remove oxygen from the high pressure air 66 prior to contacting the non-metallic plate. In another embodiment, the oxidation resistant material 84 prevents oxygen from contacting the non-metallic plate 56.

What is claimed is:

1. A sealing arrangement for a gas turbine engine comprising:

a housing having a first portion and a second portion, said second portion being distal from said first portion, said second portion having a lip portion;

a shaft being disposed through said housing;

a first seal being disposed proximate said first portion, said first seal being intermediate said shaft and said housing, said first seal having high temperature mechanical strength; and a polymeric seal being disposed intermediate said first seal and said second portion, said polymeric seal being intermediate said shaft and said housing, said polymeric seal having a glass transition temperature above a predetermined operating temperature, said polymeric seal being adjacent said lip portion.

2. The sealing arrangement as specified in claim 1 further comprising an oxidation prone material disposed intermediate said lip portion and said polymeric seal.

3. The sealing arrangement as specified in claim 1 wherein said operating temperature is above 640 F.

4. The sealing arrangement as specified in claim 1 further comprising a nut adjacent said first seal, said nut being adapted to hold said first seal in contact with said polymeric seal.

* * * * *